United States Patent [19]

Epis

[11] Patent Number: 4,465,107

[45] Date of Patent: Aug. 14, 1984

[54] MEANS FOR CONTROLLING KNIFE OSCILLATIONS AND HOOK MOVEMENTS IN A LOOM DOBBY

[75] Inventor: Olivo Epis, Ponte Nossa, Italy

[73] Assignee: Fimtessile Fabbrica Italiana Macchinario Tessile S.p.A., Italy

[21] Appl. No.: 405,359

[22] Filed: Aug. 5, 1982

[30] Foreign Application Priority Data

Aug. 6, 1981 [IT] Italy ..... 23413 A/81

[51] Int. Cl.[3] ..... D03C 1/00; D03C 1/28; D03C 1/06

[52] U.S. Cl. ..... 139/66 R; 139/71

[58] Field of Search ..... 139/66-74, 139/331

[56] References Cited

FOREIGN PATENT DOCUMENTS

| | | | |
|---|---|---|---|
| 1760796 | 10/1970 | Fed. Rep. of Germany | 139/71 |
| 2064424 | 5/1972 | Fed. Rep. of Germany | 139/71 |
| 2338124 | 2/1975 | Fed. Rep. of Germany | 139/71 |
| 2444506 | 3/1975 | Fed. Rep. of Germany | 139/71 |
| 48-31946 | 10/1973 | Japan | 139/71 |

*Primary Examiner*—James Kee Chi

*Attorney, Agent, or Firm*—Stevens, Davis, Miller & Mosher

[57] ABSTRACT

An improved dobby uses linkages for controlling the oscillations of the fixed and mobile knives about their axes which comprise first levers fixed to the knives, second levers fixed to control shafts, and connecting rods which link said first and second levers together to form an articulated parallelogram.

In this dobby, the hook operating rods are controlled by the same shafts which control the knife oscillations, by means of an articulated joint.

5 Claims, 4 Drawing Figures

MEANS FOR CONTROLLING KNIFE OSCILLATIONS AND HOOK MOVEMENTS IN A LOOM DOBBY

BACKGROUND OF THE INVENTION

This invention relates to improvements in dobbies, i.e.; in those apparatus which form the shed in looms.

More specifically, the invention relates to improvements in the means for controlling the fixed and mobile knife oscillations and the hook movements, which in a constructionally simple and operationally effective manner ensure the formation of play between the hooks and knives before their engagement and at the moment of their disengagement, and the total elimination of said play during the operational engagement between said dobby elements.

SUMMARY OF THE INVENTION

Substantially, the invention relates to linkages for controlling the oscillations of the fixed and mobile knives about their axes, characterised by comprising first levers fixed to the knives, second levers fixed to control shafts, and connecting rods which link said first and second levers together, said control shafts being aligned on a common axis and mutually abutting, and the linkages forming an articulated parallelogram.

The invention also relates to a combination of said linkages with control means for the hook movements, characterised in that the hook operating rods are controlled by the same shafts which control the knife oscillations by means of first levers pivoted to said operating rods and rocking about a fixed point, second levers fixed onto said shafts, and connecting rods which connect said first and second levers together.

BRIEF DESCRIPTION OF THE DRAWINGS

The invention is described in greater detail hereinafter by way of example with reference to the accompanying drawings, which represent a preferred embodiment thereof and in which.

DESCRIPTION OF THE PREFERRED EMBODIMENT

Dobbies are mechanical apparatus by means of which the shed is formed in looms starting from a predetermined fabric design which is transferred in the form of code onto a punched tape, which when read by means of needles controls rocker levers which govern the movement of the heald frames.

Figure 1:
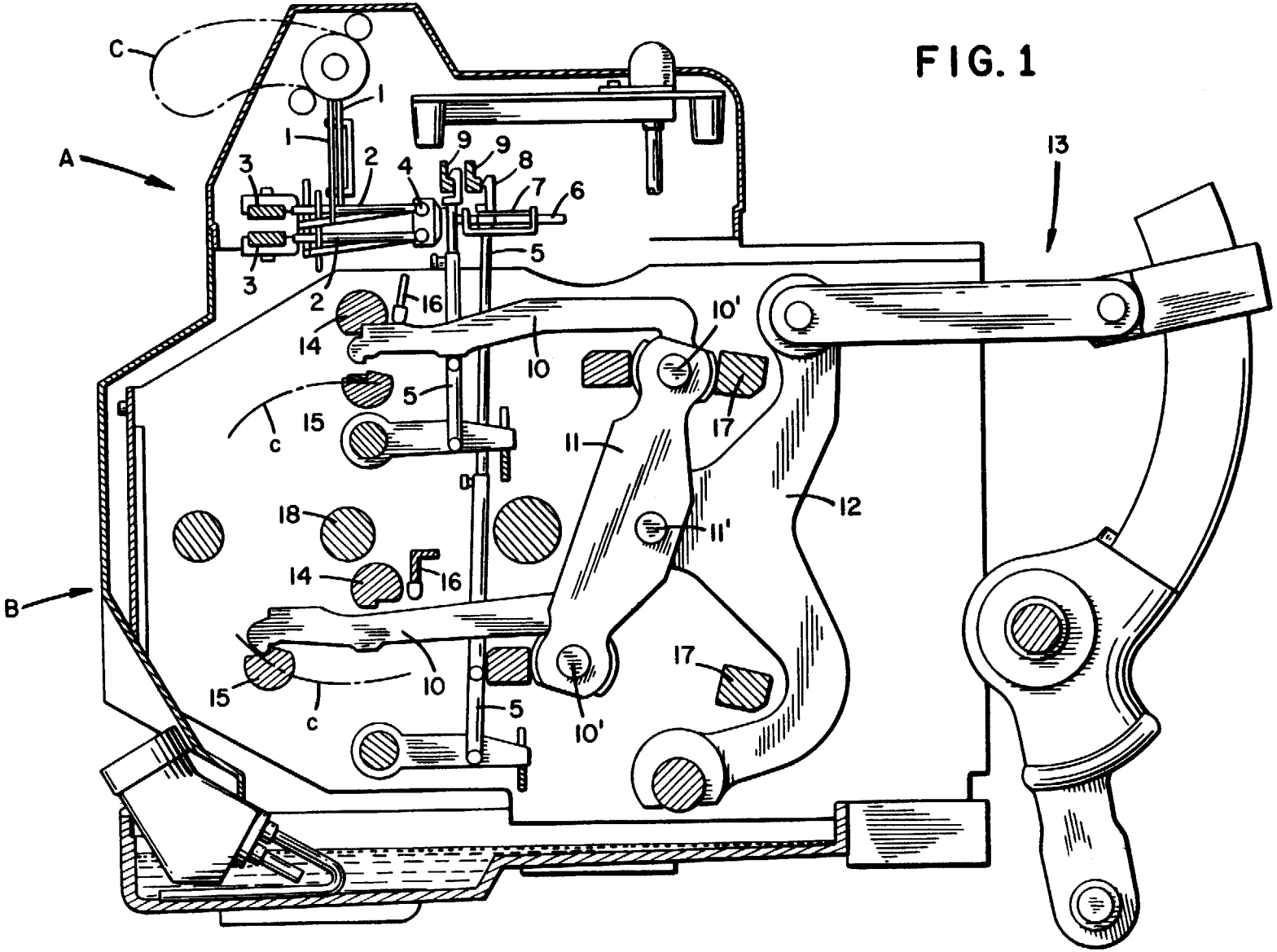
FIG. 1 is a general diagram of a dobby of known type, incorporating the improvements according to the invention.

FIG. 1 of the accompanying drawings represents a diagram of a known Hattersley dobby. This diagram shows a reading unit A and a control unit B. The purpose of the reading unit A is to read a punched paper tape C, and comprises reading needles 1, thrust rods 2 oscillating under the control of the needle 1, pressure bars 3 for engaging and thrusting the rods 2 selected by the needles 1, and control rockers 4 controlled by the rods 2. The purpose of the control unit B is to determine the movements of the heald frames under the control of the reading unit A, and comprises vertical control rods 5 controlled by horizontal needles 6 subjected to the action of the rockers 4 and of return springs 7 in order to establish and remove the engagement with lifting blades 9 by way of upper end hook portions 8. It also comprises hooks 10 pivoted at 10' to the ends of rocker levers 11 which in their turn are pivoted at 11' to the centre of transmission levers 12 which operate lever systems 13 for controlling the heald frames. The vertical rods 5 engage with the hooks 10 in order to raise them and lower them in accordance with commands received from the rockers 4 of the reading unit A. The hooks 10 engage with fixed knives 14 and mobile knives 15 in order to control the rocker levers 11. Engagement with the fixed knives 14 occurs when the rods 5 raise the hooks under the control of the lifting blades 9 with which the hook portions 8 cooperate. Engagement with the mobile knives 15 occurs when the rods 5 do not exert positive force on the hooks. The movements impressed by the rocker levers 11 and transmission levers 12 on the lever systems 13 and thus on the heald frames leading to the formation of the shed, derive from the combination of these engagements and the law governing the movement of the mobile knives 15.

It should be noted that in reality the fixed knives 14 have only their axes fixed, in the sense that they undergo oscillations about this latter for the purpose of facilitating their engagement with the hooks. In contrast, besides undergoing a similar oscillation about their axes (again to facilitate engagement with the hooks), the mobile knives move such that their axes travel along trajectories in the form of circular arcs c having their centre on the axis of the shaft 18 which produces this movement.

It should also be noted that the hooks are lowered as a rule under the positive control of hook lowering plates 16 which ensure disengagement of the hooks from the fixed knives and facilitate their engagement with the mobile knives.

As stated, at the moment the hooks 10 are to engage with the knives 14 and 15, it must be ensured that there is sufficient play present to enable the engagement to be made, whereas when this engagement has been made all possible play must be eliminated so that the hooks are able to control the lever systems for the heald frames.

Figure 2:
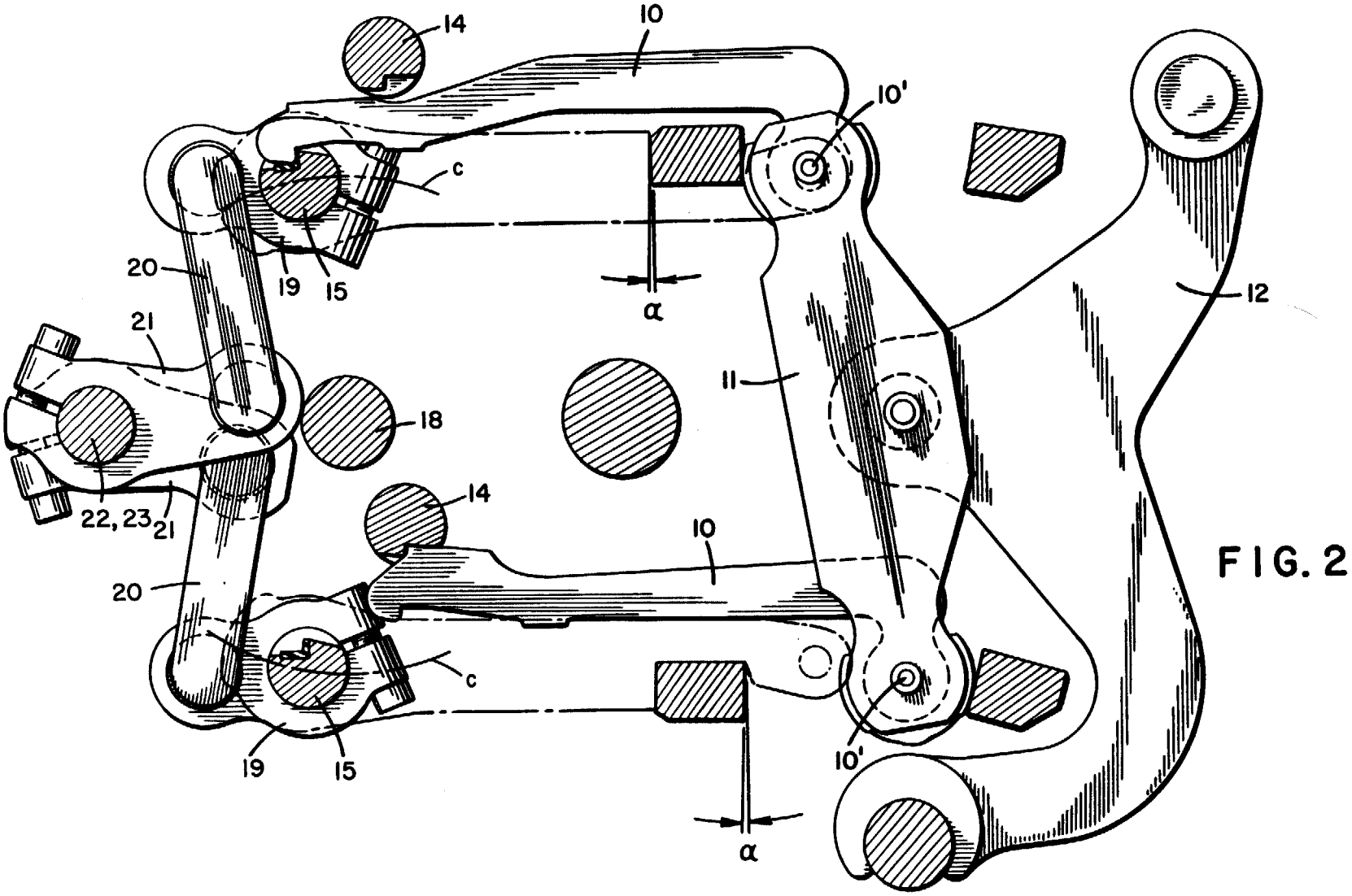
FIG. 2 is a detailed view of the improved linkages for controlling the oscillations of the dobby mobile knives, according to the invention.
Figure 3:
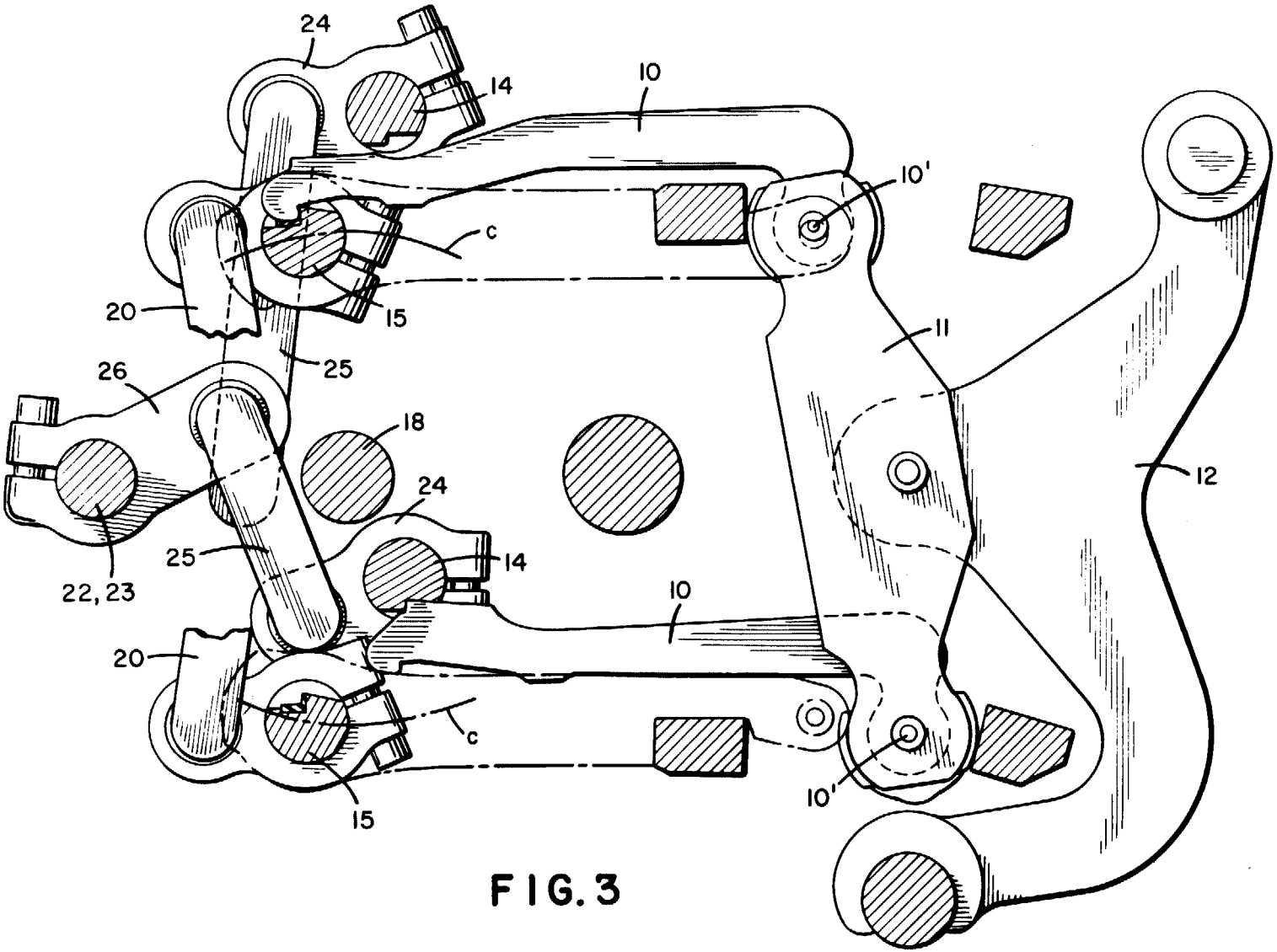
FIG. 3 is a detailed view of the improved linkages for controlling the oscillations of the dobby fixed knives, according to the invention.

The linkages which according to the present invention attain this object are shown in FIGS. 2 and 3 of the accompanying drawings.

FIG. 2 shows the linkages which control the oscillations of the mobile knives 15 about their axes.

The knives 15 move in known manner along trajectories in the form of circular arcs c having their centres on the axis of a shaft 18. These movements (or oscillations about said centre) are followed, according to the invention, by levers 19 fixed onto the knives 15 and to which are pivoted the first ends of connecting rods 20, the second ends of which are pivoted to control levers 21. The levers 21 are carried by and fixed onto separate mutually abutting shafts 22 and 23 which are aligned on a common axis. As can be easily seen, the arrangement is such as to give rise to linkages in the form of articulated 4-sided polygons of great simplicity and effectiveness. The vertices of said 4-sided polygons correspond to the axes of the knives 15, to the pivoting points of the connecting rods 20 at the levers 19 and 21, and to the axis of the shaft 18.

FIG. 3 shows the linkages which control the oscillations of the fixed knives 14 about their axes. These comprise levers 24 fixed onto the knives 14, and to which are pivoted the first ends of connecting rods 25, the second ends of which are pivoted to control levers 26 fixed onto the same shafts 22, 23 on which the levers 21 of the preceding linkages are fixed. These linkages 24, 25, 26 also form articulated 4-sided polygons similar to those of the preceding case.

When in operation, the shafts 22, 23 are rotated at the opportune moment in order to cause the fixed knives 14 and mobile knives 15 to swivel in suitable directions about their axes in order to create play with respect to the hooks 10 immediately before engaging therewith, and to eliminate said play immediately after said engagement has taken place, and to again restore said play immediately before the hooks disengage from the knives.

The parallelogram structure of the described and illustrated linkages simplifies their design and manufacture, and make their operation particularly effective.

Figure 4:
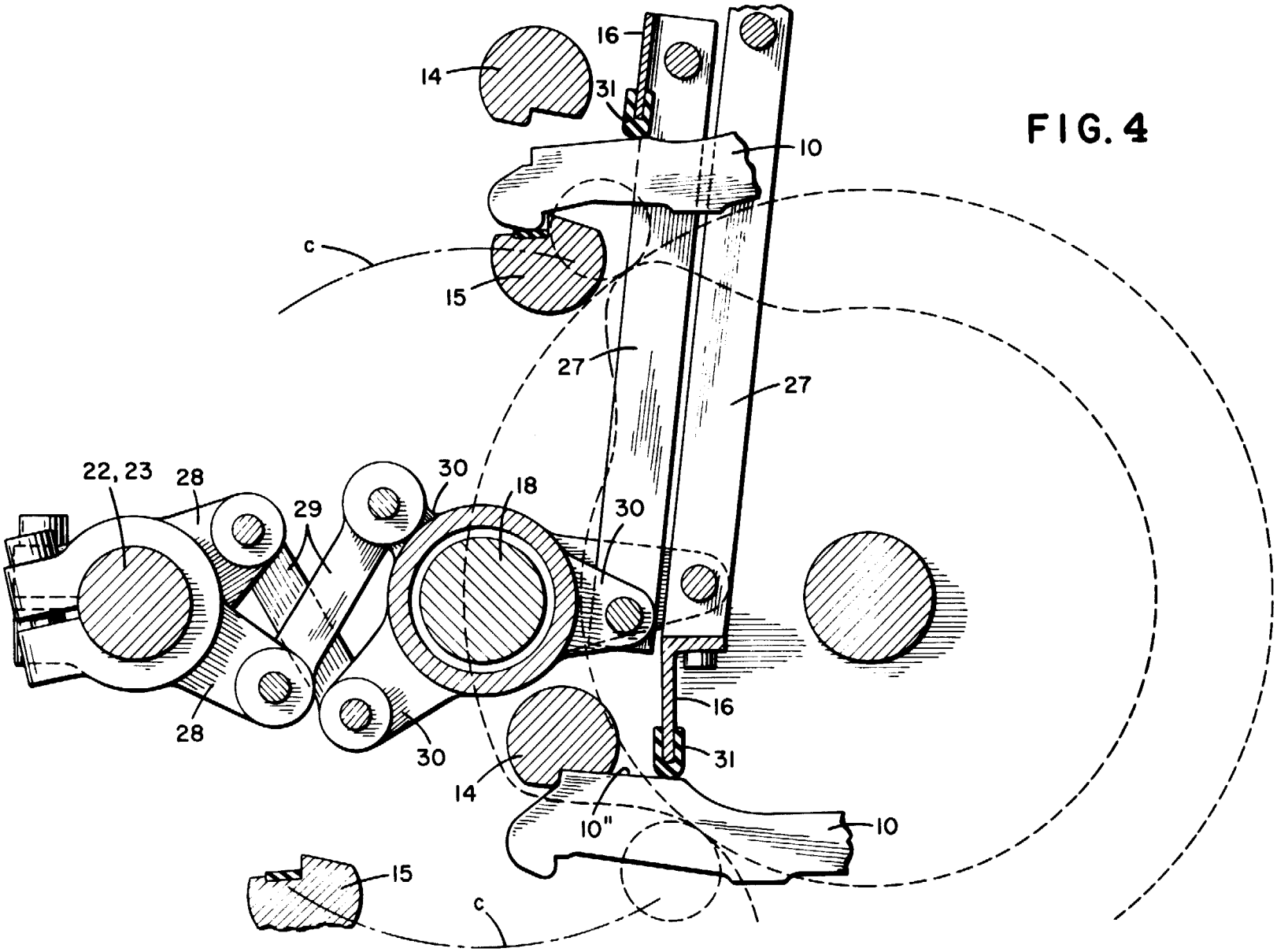
FIG. 4 shows the means for controlling the hook movements in a dobby fitted with the knife control linkages of FIGS. 2 and 3.

The hook movement control means illustrated in FIG. 4 can be advantageously combined with said linkages. In these means, the operating rods 27 of the hook lowering plates 16 are controlled by the same shafts 22, 23 which control the described linkages for producing the knife oscillations, by way of lever systems comprising levers 28 fixed onto said shafts, and connecting rods 29 which link the levers 28 to levers 30 rotating about the shaft 18 and pivoted to the operating rods 27 of the hook lowering plates 16. According to the invention, the hook lowering plates 16 comprise a covering of anti-impact material 31 for engaging the surface 10'' of the hooks 10.

The levers 28 which operate the hook lowering plates, and which are guided in rectilinear guides (not shown), are also used for controlling the movements of the lifting blades 9 for the hooks 10, so that the described arrangement can be effectively considered as the means for controlling the hook movements.

Other embodiments of the linkages controlling the oscillations of the knives about their axes and the hook movements in a dobby which are different from that described and illustrated can also fall within the scope of the present invention. Modifications to the embodiment described and illustrated also fall within this scope.

I claim:

1. Linkages for controlling those oscillations of the fixed and mobile knives of a dobby which are intended to facilitate correct engagement of said knives with the dobby hooks, characterised by comprising first levers fixed to the knives, second levers fixed to control shafts, and connecting rods which link said first and second levers together, said control shafts being aligned on a common axis and mutually abutting, and the linkages forming two articulated 4-sided polygons having vertices, one of the vertices of one polygon being in common with a vertice of the other polygon.

2. Control linkages as claimed in claim 1, wherein the vertices of said articulated 4-sided polygons are determined by the knife axes, the points at which said connecting rods are pivoted to said first and second levers, and the axes of the shaft which produces the movements of the mobile knives along trajectories in the form of circular arcs with their centre on said axes.

3. A combination of the oscillation control linkages for the fixed and mobile knives of a dobby with control means for the movements of the hooks of said dobby, characterised in that the hook operating rods are controlled by the same shafts which control the knife oscillations by means of first levers pivoted to said operating rods and rocking about a fixed point, second levers fixed onto said shafts, and connecting rods which connected said first and second levers together.

4. A combination as claimed in claim 3, wherein said first levers are mounted rotatable about the shaft which produces the circular arc movements of the mobile knives.

5. A combination as claimed in claim 3, wherein the hook lowering plates carried by said operating rods comprise a covering of anti-impact material for engaging the hooks.

* * * * *